United States Patent [19]

Arai et al.

[11] 4,402,285

[45] Sep. 6, 1983

[54] SELF-CONTAINED HYDRAULIC LASH ADJUSTER

[75] Inventors: Fuminao Arai, Kawiya; Hisashi Kodama, Nagoya; Yoshio Okabe, Kariya, all of Japan

[73] Assignee: Aisin Seiki Kabushiki Kaisha, Kariya, Japan

[21] Appl. No.: 238,792

[22] Filed: Feb. 27, 1981

[30] Foreign Application Priority Data

Mar. 3, 1980 [JP] Japan ..... 55-26437

[51] Int. Cl.[3] ..... F01L 1/24

[52] U.S. Cl. ..... 123/90.58; 123/90.46

[58] Field of Search ..... 123/90.55, 90.57, 90.58, 123/90.46, 90.56, 90.59

[56] References Cited

U.S. PATENT DOCUMENTS

| | | | |
|---|---|---|---|
| 1,798,938 | 3/1931 | Hallett | 123/90.57 |
| 2,109,815 | 3/1938 | Best | 123/90.58 |
| 2,754,811 | 7/1956 | Dayton | 123/90.55 |
| 3,025,842 | 3/1962 | Van Slooten | 123/90.58 |
| 4,338,894 | 7/1982 | Kodama | 123/90.58 |

FOREIGN PATENT DOCUMENTS

| | | | |
|---|---|---|---|
| 54-141915 | 11/1979 | Japan | 123/90.57 |

*Primary Examiner*—Craig R. Feinberg
*Assistant Examiner*—W. R. Wolfe
*Attorney, Agent, or Firm*—Sughrue, Mion, Zinn, Macpeak and Seas

[57] ABSTRACT

A self-contained hydraulic lash adjuster of the type having a hollow cylindrical plunger slidably and sealingly disposed in a hollow cylindrical body, a reservoir chamber in the plunger, a pressure chamber between the bottom of the plunger and the bottom of the body and a one-way valve controlled passage between said chambers is further provided with a second plunger slidably and sealingly disposed in the reservoir chamber on the upper surface of the hydraulic working fluid therein.

5 Claims, 3 Drawing Figures

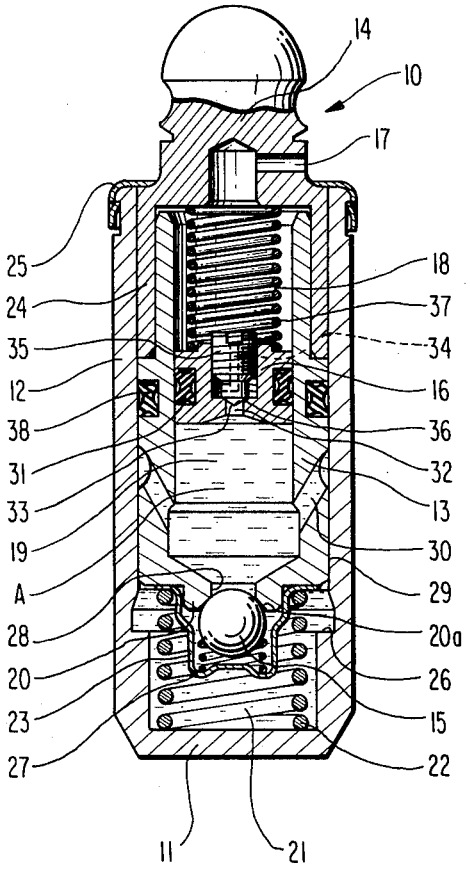
FIG. 1
FIG. 2
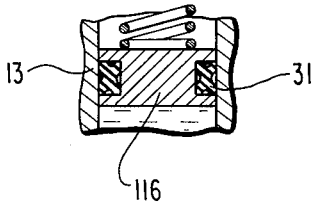
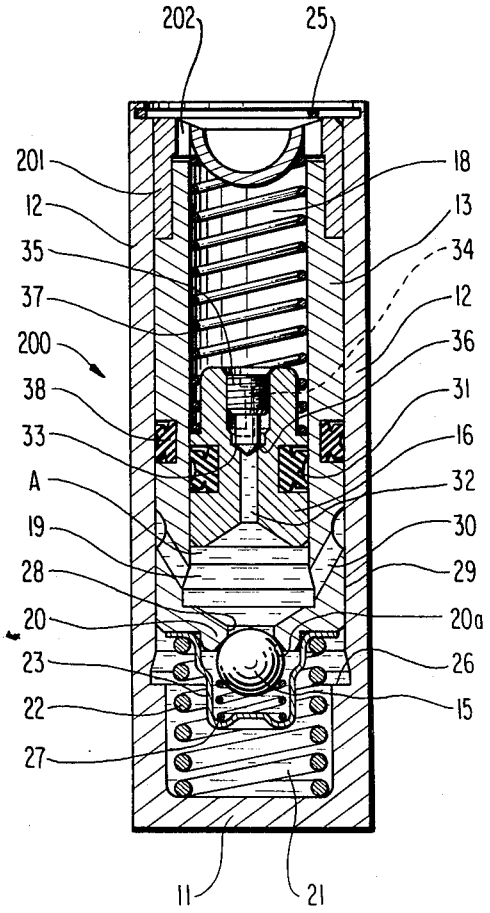
FIG. 3

SELF-CONTAINED HYDRAULIC LASH ADJUSTER

BACKGROUND OF THE INVENTION

1. Field of the Invention

The present invention relates to hydraulic lash adjusters used in valve trains of internal combustion engines and more particularly to a self-contained hydraulic lash adjuster in which the fluid is sealed within the assembly with no provision for its replenishment from any external source during operation.

2. Prior Art

In the valve trains of internal combustion engines predetermined valve clearances are generally provided in order to compensate for thermal expansion of various parts in the valve trains. However, since excess lash may be generated due to the valve clearances in the valve trains during engine operation, hydraulic lash adjusters have been used for automatically taking up the valve clearances in the valve trains thereby preventing any possible lash in stabilizing the opening and closing operation of the engine intake or exhaust valves.

Conventional hydraulic lash adjusters compensate for fluid leakage by means of supplying pressurized fluid to the interior of the lash adjusters through passageways in the cylinder block. However, there are disadvantages to such an arrangement since the passageways through which the pressurized fluid flows are complicated in construction and the operation is often unstable due to changes in the viscosity of the pressurized fluid. In order to eliminate such disadvantages hydraulic lash adjusters of the self-contained type have been provided which are not fed from an external source of hydraulic fluid but contain their own source of such fluid.

In conventional hydraulic lash adjusters of the self-contained type there are still drawbacks since the mechanism compensating for fluid leakage is often imperfect, the operation might become unstable due to the entrapment of air in the fluid and the mechanism of the lash adjuster is quite complicated and expensive to manufacture.

An example of a self-contained hydraulic lash adjuster is disclosed in the Kodama U.S. Pat. No. 4,191,142. The selfcontained lash adjuster disclosed in the Kodama patent includes a cylinder member and a plunger member slidably fitted therein to define a fluid pressure chamber between each end wall. The plunger member is provided with a reservoir chamber therein and an elastic bag member is disposed within the reservoir chamber with the inner wall surface of the elastic bag member being normally in communication with atmospheric pressure while the outer wall surface thereof is disposed in contact with the fluid in the reservoir chamber.

SUMMARY OF THE INVENTION

The present invention provides a new and improved hydraulic lash adjuster of the self-contained type which is not fed from an external source of hydraulic fluid and which overcomes the aforementioned difficulties of prior art constructions.

The present invention provides a new and improved self-contained hydraulic lash adjuster having a first hollow cylindrical plunger slidably and sealingly disposed in a hollow cylindrical body to define a pressure chamber between the end walls thereof and a reservoir chamber within said first hollow plunger. One-way valve means in the bottom of said first plunger provide for fluid flow from said reservoir to said first pressure chamber while radial passage means and leakage clearance between the first plunger and said housing provide for fluid flow from said pressure chamber to said reservoir. A second plunger is slidably and sealingly disposed within said reservoir in contact with the surface of the hydraulic fluid in said reservoir. The second plunger may be provided with closeable passage means communicating said reservoir with the atmosphere.

The present invention provides a new and improved self-contained hydraulic lash adjuster which is simple in construction, inexpensive to manufacture and easy to assemble and fill with hydraulic fluid.

The foregoing and other objects, features and advantages of the present invention will be apparent from the following more particular description of preferred embodiments of the invention as illustrated in the accompanying drawings.

BRIEF DESCRIPTION OF THE DRAWINGS

FIG. 1 is a longitudinal sectional view through the self-contained hydraulic lash adjuster according to a first embodiment of the present invention.

FIG. 2 is a partial sectional view of a self-contained hydraulic lash adjuster showing a modified construction of the second plunger.

FIG. 3 is a longitudinal sectional view of a self-contained hydraulic lash adjuster similar in construction to the embodiment of FIG. 1 but modified for use in an overhead valve type internal combustion engine.

DETAILED DESCRIPTION OF THE INVENTION

The self-contained hydraulic lash adjuster 10 shown in FIG. 1 is provided with a cylindrical housing 12 the upper end of which is open for the reception of a fulcrum member 14. A first plunger 13 is slidably disposed within the cylindrical housing 12 and is provided with an annular sealing ring 38 having a K-shaped cross-sectional configuration disposed in contact with the inner wall of the housing 12. A second plunger 16 made of aluminum is slidably disposed in and divides the interior of the first plunger 13 into two compartments 18 and 19. The chamber 18 is open to the atmosphere and the chamber 19 is a reservoir chamber for hydraulic fluid. A pressure chamber 21 is defined between the bottom wall 20 of the first plunger 13 and the bottom wall 11 of the housing 12.

The first plunger 13 is continuously biased upwardly as viewed in FIG. 1 by means of a spring 22 disposed between the bottom wall 11 of the housing 12 and the spring retainer 23 secured to the bottom wall 20 of the first plunger 13. The upward movement of plunger 13 is limited by engagement with the annular extension 24 on the fulcrum member 14 and the upward movement of the fulcrum member 14 is restricted by an annular cap 25 which is secured to the open end of the housing 12. The first plunger 13 is movable downwardly in accordance with the movement of the fulcrum member 14 and the downward movement of the plunger 13 is limited by the annular shoulder portion 26 on the interior wall of the housing 12.

A fluid passage 28 extends through the bottom wall 20 of the plunger 13 and is controlled by ball valve 15 normally biased into engagement with a conical valve seat 20*a* by a spring 27 between retainer 23 and ball valve 15. When the pressure chamber 21 and the reservoir chamber 19 are filled with a working fluid such as silicon oil, communication between reservoir chamber 19 and the pressure chamber 21 through the passage 28 is normally interrupted by the ball valve 15. Upon downward movement of the first plunger 13 as viewed in FIG. 1 oil is forced upwardly through the clearance 29 between the inner wall of the housing 12 and the outer wall of the plunger 13 and passes inwardly into the reservoir chamber 19 through passages 30. Upon upward movement of the plunger 13 as viewed in FIG. 1 the fluid within the reservoir chamber 19 may pass through the passage 28 into the pressure chamber 21 past the ball valve 15.

The second plunger 16 is sealingly disposed in the first plunger 13 by means of an annular sealing ring 31 located in an annular groove in the plunger 16. The sealing ring 31 has a K-shaped cross-sectional configuration and is disposed in sliding engagement with the interior wall of the first plunger 13. The second plunger 16 is provided with a stepped bore 32 and a stepped screw 35 is threaded into the larger diameter portion thereof. The screw 35 is provided with a bleed passage 34 and has a conical valve portion 33 on the end of the smaller diameter portion which is adapted to engage the annular valve seat 36 formed about the upper end of the smaller diameter portion of the bore 32. When the valve portion 33 of screw 35 is out of contact with the seat 36 air oil may pass from the reservoir chamber 19 into the atmospheric chamber 18. When valve portion 33 is seated against the annular seat 36 all communication between the reservoir chamber 19 and the atmospheric chamber 18 is interrupted.

During assembly of the self-contained hydraulic lash adjuster the reservoir chamber 19 and the pressure chamber 21 are filled with oil A up to the upper end of the first plunger 13. The second plunger 16 is then placed on the upper surface of the operating oil A and screw 35 is backed off from the seat 36 to allow communication between the reservoir chamber 19 and the atmospheric chamber 18 through the bore 32 and passage 34. Thereafter, the second plunger 16 is pressed into the first plunger 13 to a predetermined position. Since the volume of the reservoir chamber 19 is decreased due to the downward insertion of the second plunger 16 the extra oil A is forced into the air chamber 18 through bore 32 and passage 34. When plunger 16 is in the desired position, the valve portion 33 is screwed into contact with the valve seat 36. The spring 37 is then located in the atmospheric chamber 18 and the fulcrum 14 is inserted into the housing 12. The annular cap 25 is then secured on the end of housing 12 to prevent removal of fulcrum 14.

In operation one end of the fulcrum member 14 is engageable with one end of a rocker arm (not shown) and the other end of the rocker arm is engageable with a valve stem (not shown) of an internal combustion engine. As is well known in the art, the rocker arm is swingable in response to rotation of a cam shaft which is rotated by the crank shaft of the engine. Accordingly, the fulcrum member 14 and the first plunger 13 are reciprocable relative to the housing 12 for taking up the lash or operating clearance in the valve train. When the fulcrum 14 and the first plunger 13 are moved downwardly as viewed in FIG. 1, the pressure in the pressure chamber 21 increases to assist spring 27 in maintaining the valve 15 closed. The pressurized oil in chamber 21 is therefore forced upwardly through the clearance 29 between plunger 13 and housing 12. In view of the sealing ring 38, the fluid cannot escape outwardly of the housing 12 and flows into the reservoir chamber 19 through the passages 30. As a result of the increase of fluid in the reservoir chamber 19, the second plunger 16 will be forced upwardly against the bias of spring 37.

When the cam shaft is further rotated, the fulcrum member 14 will become free to move upwardly and the spring 22 will move the first plunger 13 and the fulcrum 14 upwardly relative to the housing as viewed in FIG. 1. The upward movement of the plunger 13 will reduce the pressure in chamber 21, thereby allowing the ball valve 15 to be moved to the open position as the fluid in reservoir chamber 19 returns to the pressure chamber 21 through the passage 28 under the influence of the spring-biased plunger 16. Therefore, as a result of the reciprocal movement of the plunger 13 relative to the housing 12, the valve operating clearance in a valve train may be kept to zero.

In the embodiment of FIG. 2, the construction of the hydraulic lash adjuster is substantially identical to that shown in FIG. 1 with the exception of the second plunger identified by the numeral 116. The second plunger 116 in the embodiment of FIG. 2 differs from the second plunger 16 in the embodiment of FIG. 1 in that it does not have a passage between the air chamber 18 and the reservoir chamber 19. The plunger 116 is slidably disposed within the first plunger 13 and is provided with an annular sealing member 31 as in the first embodiment. During assembly, the first plunger 13 is inserted into the housing until the bottom end of the plunger 13 rests on the shoulder 26 of the housing 12. The pressure chamber and reservoir chamber are then filled with oil while keeping the plunger 13 in contact with the shoulder 26. The second plunger 116 is then placed in the first plunger 13 and moved to a predetermined position within the first plunger which is dictated by the force of the spring 22 as it moves the plunger 13 upwardly. The amount of volume change in pressure chamber 21 is defined between the uppermost and lowermost positions of the first plunger 13. Therefore, the level of oil increase in the reservoir chamber 19, which is responsive to a volume change in pressure chamber 21, is desirably designed without providing a passage in the second plunger 116.

In the embodiment of FIG. 3, the lash adjuster 200 is suitable for use in an overhead valve-type internal combustion engine. The bottom 11 of the housing 12 is engageable with a cam shaft (not shown) which is rotated by a crank shaft (not shown). A cup member 201 having air passages 202 is disposed on the upper end of the first plunger 13. The cup member 201 is engageable with the lower end of a pushrod (not shown) which is in contact with a rocker arm (not shown). When the housing 12 is moved upwardly in response to the rotation of the cam shaft, the load on cup member 201 increases to thereby raise the pressure in the pressure chamber 21. Thus, the one-way valve 15 is kept in the closed position and the operating oil then flows from the pressure chamber 21 to the reservoir chamber 19 through clearance 29 and passages 30. Accordingly, the first plunger 13 is moved downwardly relative to the housing 12 by a predetermined distance. When the cam shaft is further rotated, the housing 12 is moved downwardly to decrease the load on the cup member and the first plunger 13 is then moved upwardly relative to the housing 12 by the force of spring 22. The valve 15 will be opened and the oil in reservoir chamber 19 will flow back into pressure chamber 21 through the passage 28. Thus the general operation of the hydraulic lash adjuster shown in FIG. 3 is essentially identical to that shown in FIG. 1 and a further detailed description of the assembly and operation is not deemed to be necessary.

In summary, the present invention is directed to a closed hydraulic lash adjuster which is provided with a second plunger in the first plunger and sealing means for both plungers to seal the operating oil in the device. Thus, there is no need for providing an oil compensation passage between the engine itself and the lash adjuster device.

While the invention has been particularly shown and described with reference to preferred embodiments thereof, it will be understood by those in the art that the foregoing and other changes in form and details may be made therein without departing from the spirit and scope of the invention.

What is claimed is:

1. A self-contained hydraulic lash adjuster comprising a hollow cylindrical housing means having a bottom wall, first hollow plunger means having a bottom wall reciprocable within said housing means, actuating means reciprocable in said housing means in engagement with said first plunger means, a pressure chamber defined between the bottom wall of said housing means and the bottom wall of said first plunger means, second plunger means slidably and sealingly disposed within said first plunger means, a reservoir chamber adapted to contain hydraulic fluid defined within said first plunger means between said second plunger means and the bottom wall of said first plunger means, first spring means interposed between said actuating means and said second plunger means for biasing said second plunger means into engagement with the surface of the fluid in said reservoir, passage means extending through the bottom wall of said first plunger means for hydraulic communication between said reservoir chamber and said pressure chamber, one-way valve means for controlling hydraulic communication through said passage means, said valve means allowing fluid flow from said reservoir chamber to said pressure chamber but prohibiting fluid flow from said pressure chamber to said reservoir chamber through said passage means, second spring means provided in said pressure chamber for constantly biasing said first plunger means away from the bottom wall of said housing means and fluid return passage means allowing fluid return from said pressure chamber to said reservoir chamber.

2. A self-contained hydraulic lash adjuster as set forth in claim 1 wherein said second plunger means includes an opening therethrough and adjustable closure means for said opening for interrupting all communication between said reservoir and the atmosphere.

3. A self-contained hydraulic lash adjuster as set forth in claim 1 further comprising stop means for limiting the movement of said first plunger means towards the bottom wall of said housing means.

4. A self-contained hydraulic lash adjuster is set forth in claim 1 wherein said one-way valve means is operatively associated with said passage means for controlling communication between said reservoir chamber and said pressure chamber by opening and closing of said passage means.

5. A self-contained hydraulic lash adjuster as set forth in claim 4 wherein said fluid return passage means is comprised of a leakage clearance between the inside wall of said housing means and the outside wall of said first plunger means and at least one passage communicating said leakage clearance with said reservoir chamber.

* * * * *